United States Patent [19]

Mastrovito

[11] 3,933,269

[45] Jan. 20, 1976

[54] HANDLE ASSEMBLY FOR CHEST

[75] Inventor: Donald Mastrovito, Shrewsbury, Mass.

[73] Assignee: Family Products, Inc., Cambridge, Mass.

[22] Filed: Dec. 26, 1972

[21] Appl. No.: 317,948

[52] U.S. Cl. ..... 220/94 R; 16/112

[51] Int. Cl. ..... B65d 25/28

[58] Field of Search ..... 220/94 R; 16/112, 125, 16/126

[56] References Cited

UNITED STATES PATENTS

| | | | |
|---|---|---|---|
| 893,445 | 7/1908 | Clark | 16/112 |
| 1,126,967 | 2/1915 | Field | 220/94 R X |
| 3,153,491 | 10/1964 | MacTavish et al. | 220/94 R X |

*Primary Examiner*—William Price
*Assistant Examiner*—Steven M. Pollard
*Attorney, Agent, or Firm*—Wolf, Greenfield & Sacks

[57] ABSTRACT

An insulated plastic storage chest includes an improved handle construction. The handle is molded from plastic and is within a retaining channel molded integrally with the sidewall of the chest. The handle attaches to the sidewall in a manner which enables the load to be transferred directly from the sidewall to the handle without intermediate connectors or fasteners. The handle construction and mode of attachment to the chest facilitate assembly of the device. The handle may be attached directly from the outside of the chest.

7 Claims, 6 Drawing Figures

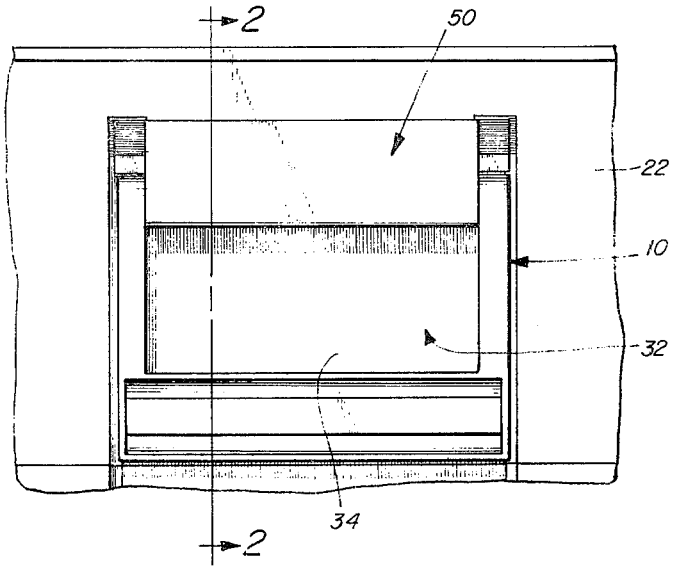
FIG. 1
FIG. 2
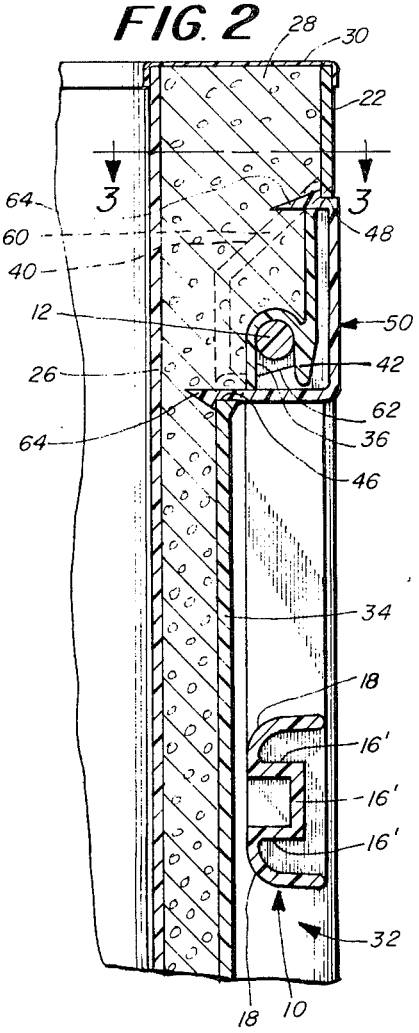
FIG. 3
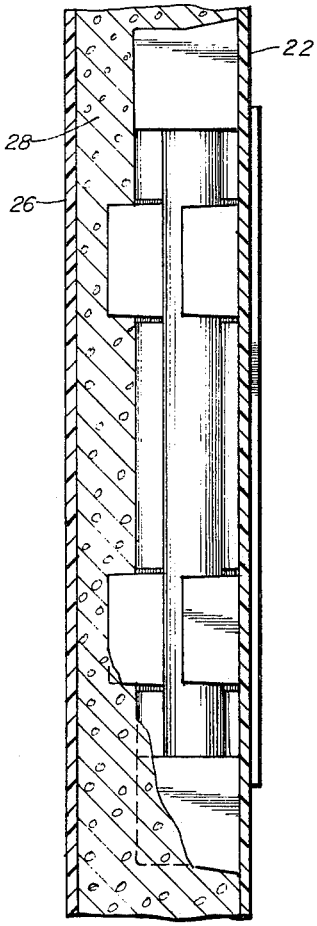

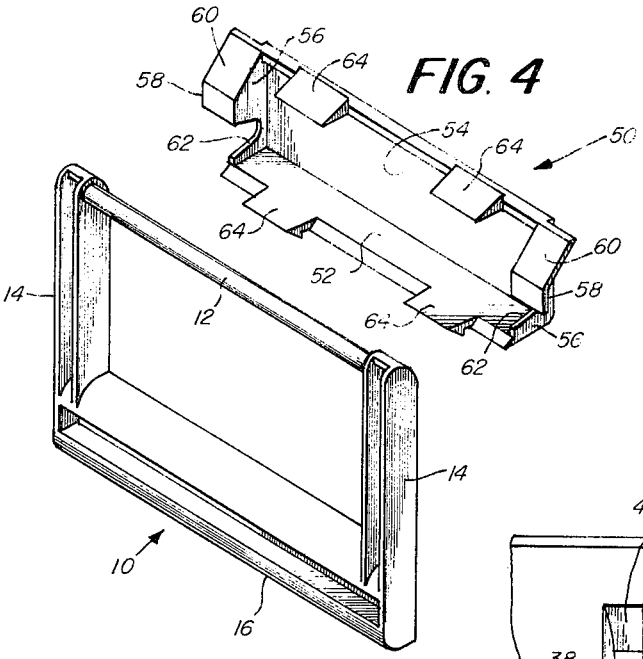
FIG. 4
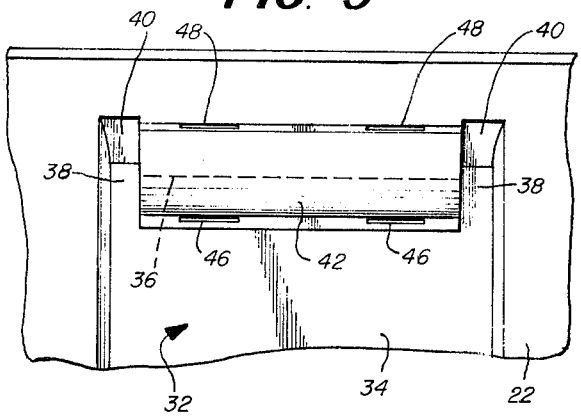
FIG. 5
FIG. 6
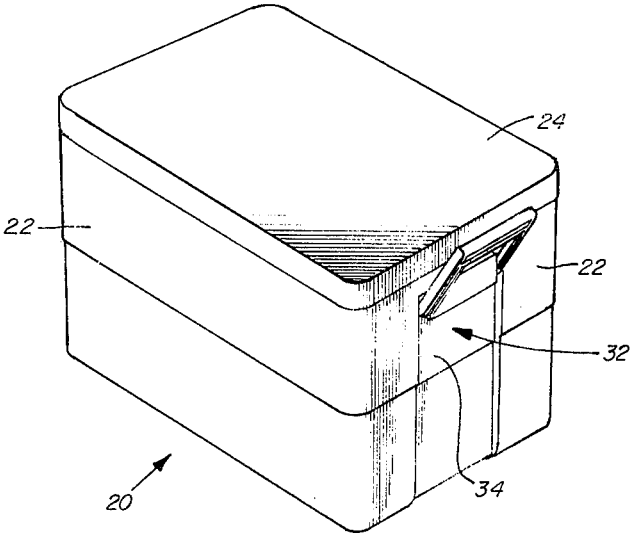

HANDLE ASSEMBLY FOR CHEST

SUMMARY OF THE INVENTION

This invention relates to improvements in plastics containers such as ice or picnic chests or the like. The chest has a recessed region in the sidewall to receive the carrying handle when the handle is not in use. The handle is of one piece molded construction having a hinge bar which is received in a specially formed channel integrally molded at the upper part of the sidewall recess. The channel opens downwardly to receive the hinge bar and is arranged to enable the load to be transferred directly from the chest wall to the handle when the chest is carried. The handle is retained in place by a special cap which covers the hinge region and which snaps directly into receptive slots formed in the sidewall of the chest. The cap includes a number of barbed fingers which are self-locking when attached to the sidewall. The device is useful especially in the construction of insulated chests and other chests where access to the inside of the chest wall is inconvenient such as where the chest includes spaced inner and outer walls with a foam insulative layer between them. The improved handle construction, however, is not limited for use solely to such insulative chests but may be employed with other chests or containers where appropriate.

Among the objects of the invention is to provide an improved handle arrangement for a container.

Further object of the invention is to provide an improved handle arrangement for a container which simplifies the manufacture and assembly of the container.

A further object of the invention is to provide a handle arrangement for a container in which the handle can be secured to the container from the outside of the container.

Another object of the invention is to provide an improved handle construction which enables the load to be transferred directly from the wall of the container to the handle. In this regard, the device is free of separate load bearing fasteners and the like.

Still another object of the invention is to provide a handle which is useful particularly with insulated containers of the type having spaced inner and outer walls separated by an inner foamed plastic layer. In the manufacture of such insulated containers, it is a common difficulty that because of pre-formed holes in the walls of the container to later receive fasteners and the like, the foam frequently blocks the holes and may sometimes exude out of the holes undesirably.

DESCRIPTION OF THE DRAWINGS

The foregoing and other objects and advantages of the invention will be understood more fully from the following detailed description thereof, with reference to the accompanying drawings wherein:

FIG. 1 is a side elevation of the sidewall of the chest with the handle mounted thereto in a relaxed configuration;

FIG. 2 is an elevation, in section, of the arrangement shown in FIG. 1 as seen along the line 2—2 of FIG. 1;

FIG. 3 is a section of the device as seen along the line 3—3 of FIG. 2;

FIG. 4 is an exploded view of the handle and cap;

FIG. 5 is an elevation of the container sidewall similar to that in FIG. 1 but before the handle and cap have been attached thereto; and FIG. 6 is an illustration of a chest with the handle attached and in its operative load-carrying configuration.

DESCRIPTION OF THE PREFERRED EMBODIMENT

FIGS. 1, 2 and 4 show the handle, indicated generally by the reference character 10. The handle 10 is of generally rectangular configuration and is easily moldable from an appropriate rigid plastic material. The handle 10 includes a round hinge bar 12 at its upper, a pair laterally spaced side bars 14 integral with the ends of the hinge bar 12 and a bottom bar 16 which serves as the hand grip portion of the handle. The side bars 14 may be of channel shaped cross sectional configuration to enhance their rigidity. The bottom bar 16 preferably includes a number of reverted segments 16' to enhance the strength of the bottom bar. Preferably, the bottom bar 16 has a smoothly curved surface 18 to enhance the comfort by which the handle may be carried.

The chest 20, shown in its entirely in FIG. 6, is illustrated as being of the insulated type. While the invention is suited for use with this type of container, it should be noted that it may be used with other types of chests or containers. The chest 20 includes a bottom wall (not shown) and a continuous sidewall 22 formed integrally with the bottom wall and extending upwardly therefrom. The chest 20 includes the usual cover 24. The sidewalls 22 and bottom wall are molded in a single integral piece from an appropriate plastic material such as high density polyethylene. The insulative type of chest shown is of double-walled construction which includes an inner container defined by an inner sidewall 26 and an inner integral bottom wall (not shown). The inner container is spaced from the outer sidewall 22 and bottom wall and the void therebetween is filled by a foamed plastic material such as foamed polyurethane. The manner of fabricating a chest having such integral sandwiched construction is well-known to those skilled in the art. The upper edge of the laminated sidewalls and foam 22, 26 and 28 sandwich may be capped with appropriate cover 30 also made from plastic.

Among the reasons that my improved handle construction is particularly useful with insulated containers of the type described above is that the usual practice in molding such containers is to preform the inner and outer containers and then fill the void therebetween with the foam 28. The preformed sidewalls of the containers typically have a number of holes formed therein for subsequent assembly and attachment of a carrying handle and other hardware. One of the frequently encountered difficulties is that when the void is filled with the foaming plastic material some of the material tends to block the openings and flow out of the openings. This is undesirable in that it hampers subsequent assembly of the handles or hardware. Among the features of the invention is that it avoids these difficulties.

A pair of handles 10 are mounted on opposite ends of the sidewall 22 which are formed to define recesses 32 receptive to the handles 10 when they are in an inoperative configuration as shown in FIGS. 1 & 2. Each recess 32 is defined by an integral recessed portion 34 of the sidewall 22. The recess 32 may extend from adjacent the upper end of the sidewall down to the bottom of the sidewall as shown in FIG. 6. Although the recess may be terminated before the lower end, the arrangement shown in FIG. 6 is preferred because it enhances the strength of the sidewall. The depth of the recess 32 is slightly more than that of the handle 10, as suggested in FIG. 2.

The upper portion of the recess 32 is formed to define a downwardly opening channel 36 which is receptive to the hinge bar 12 of the handle 10. The length of the channel 36 is less than that of the hinge bar 12 and is less than width of the recess 32 to define sockets 38 receptive to the upper ends of the handle side bars 14. The upper ends of the socket define an upwardly and outwardly inclined surface 40 which, as described below, receives a similarly shaped insert to define a limit stop to preclude the handle from being raised beyond the attitude shown in FIG. 6 and in phantom in FIG. 2. This arrangement maintains the gripped bottom bar 16 of the handle in spaced relation to the sidewall of the chest so that the chest may be carried more comfortably.

The outer edge of the channel is formed to define a relatively thick lip 42. Formed integrally with and extending upwardly from the lip 42 is a continuation 44 of the sidewall which is recessed only slightly from the outer sidewall 22. A pair of slots 46 are formed just below the lower end of the channel. In the preferred embodiment, the channel is spaced slightly outwardly from the recessed portion 34 of the sidewall at the region where the slots 46 are defined. Similarly, a pair of slots 48 are formed at the juncture of the sidewall 22 and the slightly recessed wall portion 44. The slots, 46, 48 cooperate with a cap 50 which fits about the channel 36 to retain the hinge bar 12 within the channel 36. It may be noted that the slots 46, 48 are relatively narrow and minimize the tendency of the foamable plastic 28 to exude through the slots during manufacture of the insulative chest. Such leaking of the foaming polyurethane may be further retarded by molding the sidewall so that a thin pierceable plastic web (not shown) remains within the openings 46.

The cap 50 also is molded in a single piece from the same material as that from which the handle 10 is formed. The cap 50 includes a bottom wall 52, a sidewall 54 and a pair of end walls 56. Integral with and extending laterally from each end wall 56 is a projection 58 including an upwardly and outwardly inclined wall 60. Each of the end walls 56 has a slot 62 formed therein. The cap 50 and its foregoing elements are dimensioned to fit over the channel region of the chest as shown in FIG. 2 to retain the hinge bar 12 in the channel 36 and to present a smooth external appearance. The cap 50 spans the entire width of the recess 32 with the projections 58 fitting within the sockets 38. When assembled, the end walls 56 of the cap 50 embrace the ends of the channel 36 and the hinge bar 12 is received within the slots 62 formed in the end walls 56. When the handle is raised to the operative configuration, the inclined portion 60 acts as the limit stop to engage the handle. When in the inoperative configuration, the handle is retained in place within the channel by reason of its engagement with slots 62 in the end walls 56 of the cap.

The cap is attached to the container by means of inwardly extending barbed fingers 64 formed integrally with the cap 50. One such barbed finger 64 is provided for each of the slots 46, 48. In the arrangement shown, the upper of the barbed fingers 64 are shorter than the lower pair. The fingers 64 are dimensioned so that they may be inserted through the slots 46, 48 so that their barbs may catch and engage the interior surfaces of the sidewall 22 and recessed portion of the sidewall 34 as shown in FIG. 2. The ends of the fingers 64 are pointed sufficiently so that they may easily pierce the foam plastic 28 inside the container wall. Additionally, if the outer sidewall 22 was formed to leave a thin web across the slots 46, 48 the pointed end of the fingers can also pass through this easily as well. The various elements of the cap 50 are dimensioned in relation to the other elements of the device so that when the cap is attached its sidewall 54 will be disposed substantially flush with chest sidewall 22. Thus, the entire handle assembly may be secured to the chest entirely from the outside by simply snapping the hinge bar into the channel and thereafter attaching the cap. This arrangement facilitates manufacture and assembly of the device. It avoids the need for additional hardware.

It should be understood that the foregoing description of the invention is intended merely to be illustrative thereof and that other embodiments and modifications may be apparent to those skilled in the art without departing from the spirit.

Having thus described the invention what I desire to claim and secure by letters patent is:

1. An improved handle construction for a container having a sidewall comprising:

means, formed integrally and in one piece with said sidewall and defining a downwardly opening channel along the exterior of the sidewall of said container, said channel generally paralleling said sidewall;

a handle having a manually grippable bottom bar, an upper hinge bar adapted to be received in said channel and means securing said bottom bar to said hinge bar in spaced relation therefrom, said hinge bar being pivotally disposed within said channel; and a cap connected to said sidewall and adapted to cover at least a portion of the open bottom of said channel thereby to retain said hinge bar therein.

2. A device as defined in claim 1 wherein said handle includes a pair of spaced side bars at opposite ends thereof, each of said side bars being connected to the opposite ends of said hinge bar, said handle bar being secured to the opposite ends of said side bars, said hinge bar being longer than the length of said channel.

3. An improved handle construction for a container having a sidewall comprising:

means defining a downwardly opening channel along the exterior of the sidewall of said container, said channel generally paralleling said sidewall;

a handle having a manually grippable bottom bar, an upper hinge bar adapted to be received in said channel and means securing said bottom bar to said hinge bar in spaced relation therefrom, said hinge bar being pivotally disposed within said channel;

a cap connected to said sidewall and adapted to cover at least a portion of the open bottom of said channel thereby to retain said hinge bar therein;

said cap further comprising a wall member adapted to cover the channel region of said sidewall and including means adapted to underlie at least a portion of said hinge bar when said hinge bar is disposed within said channel, thereby to retain said hinge bar in said channel;

said cap further including finger means secured thereto and extending inwardly therefrom, said finger means having a pointed end and a barbed formed thereon, said sidewall having apertures formed therein in locations adapted to receive said barbed fingers of said cap, said apertures, cap and fingers being dimensioned and disposed so that when said fingers are urged through said openings said barbs may catch the inner surface of said chest sidewall and thereby be retained.

4. A device as defined in claim 3 wherein said sidewall of said chest includes an inner region of foamed plastic material secured to the inner surface of said sidewall, said barbs being sufficiently sharp as to enable them to pierce and pass through said foam to enable said barbs to engage the inner surface of said sidewall.

5. A device as defined in claim 3 wherein said chest includes upper and lower of said apertures above and below said channel and wherein said cap includes upper and lower of said finger means thereby to engage and be secured to said sidewall at locations above and below said channel means.

6. A device as defined in claim 1 further comprising:

said sidewall of said chest including a recessed portion, said channel being formed at the upper end of said recessed portion, said recessed portion being of a depth slightly greater than the thickness of said handle, said recess being of greater dimensions of said handle to enable said handle to be recessed therein when in an inoperative position; and said cap spanning substantially the width of said recessed portion at the upper end thereof about said channel.

7. A device as defined in claim 6 wherein said channel is of lesser width than said recessed portion thereby to define a pair of sockets on either side of the ends of said channel, said sockets being of a width sufficient to receive the upper ends of the side bars of said handle; and said cap including lateral extensions dimensioned to fit within said sockets, said lateral extensions each including and upper member inclined upwardly and outwardly from said sidewall, said inclined member being disposed to define a limit stop engageable with said side bars of said handle to limit the extent to which said handle may be pivoted in its upward operative configuration.

* * * * *